US006020730A

United States Patent [19]

Jurek et al.

[11] Patent Number: 6,020,730

[45] Date of Patent: Feb. 1, 2000

[54] CURRENT SOURCE AND METHOD THEREFOR

[75] Inventors: Kevin J. Jurek, Gilbert; William O. Mathes, Tempe; Lalit O. Patel, Mesa, all of Ariz.

[73] Assignee: Motorola, Inc., Schaunburg, Ill.

[21] Appl. No.: 09/273,999

[22] Filed: Mar. 22, 1999

[51] Int. Cl.[7] ..... G05F 3/12

[52] U.S. Cl. ..... 323/312; 323/313

[58] Field of Search ..... 323/312, 313, 323/314, 315

[56] References Cited

U.S. PATENT DOCUMENTS 5,142,219 8/1992 Hsu et al. ..... 323/314

5,892,356 4/1999 Chuang ..... 323/315

*Primary Examiner*—Y. J. Han

*Attorney, Agent, or Firm*—Dana B. LeMoine; Timothy J. Lorenz

[57] ABSTRACT

A method and apparatus for controlling current flow in current sources includes a current source FET (18), a control FET (20), and a driver circuit which includes complementary logic (310). The use of complementary logic for control advantageously allows commonly available logic functions to control the current flow in individual current sources while maintaining a substantially constant bias voltage on the gate of the current source FETs. A chip-wide bias generator can be maintained substantially constant while controlling individual current sources.

10 Claims, 3 Drawing Sheets

300

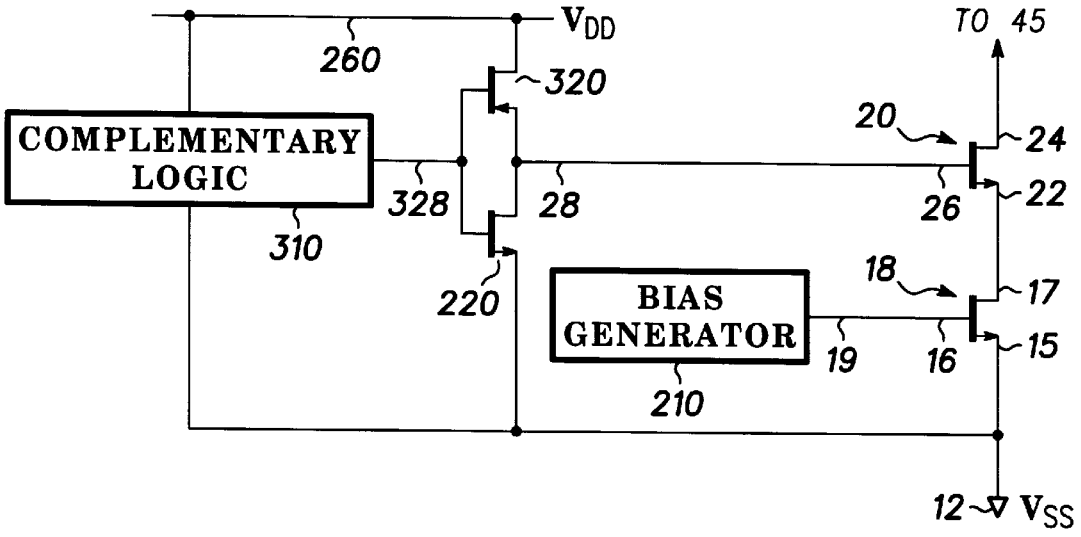
300 FIG. 3

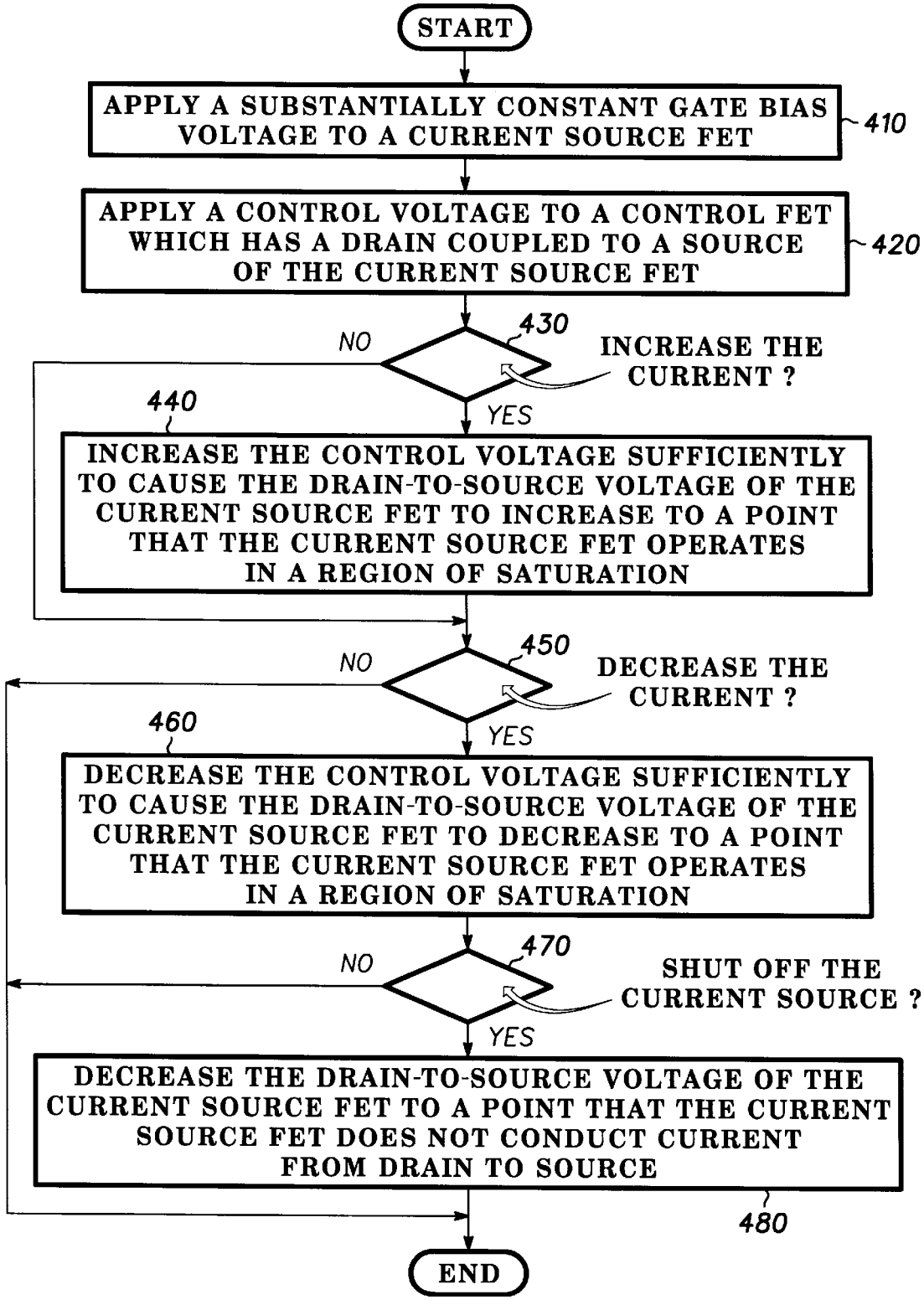
400 FIG. 4

CURRENT SOURCE AND METHOD THEREFOR

FIELD OF THE INVENTION

This invention relates in general to integrated circuits and, in particular, to current sources.

BACKGROUND OF THE INVENTION

Current sources are used to supply substantially constant current in electronic devices. For example, certain high speed logic families utilize current sources to generate currents that are switched from one path to another to signify a logical change of state. These types of logic families are generally referred to as current steering logic.

Advantages of current steering logic include very fast switching speed. It can be much faster to switch currents from one path to another than to start and stop currents. Disadvantages of current steering logic include high power consumption. Because the currents are constantly flowing, power consumption does not stop. It would be desirable to efficiently control the current flow in current sources, so as to reduce power consumption where possible. This includes the ability to control only a portion of the total number of current sources in a single integrated circuit.

Prior art approaches to control current sources are exemplified by that of Hsu et. al. described in U.S. Pat. No. 5,142,219, issued Aug. 25, 1992. These prior art approaches include different bias generators for each current source or bank of current sources which is to be independently controlled. It would be desirable to control individual current sources or banks of current sources without requiring different bias generators.

What is needed is an apparatus and method for efficiently and quickly controlling the flow of current in current sources. What is further needed is an apparatus and method for allowing individual control of current sources in an integrated circuit without requiring multiple bias generators.

BRIEF DESCRIPTION OF THE DRAWINGS

FIG. 3 shows a current source in accordance with a second embodiment of the present invention; and FIG. 4 shows a flowchart of a method of controlling a current source in accordance with a preferred embodiment of the present invention.

DETAILED DESCRIPTION OF THE DRAWINGS

The method and apparatus of the present invention provide for controlling the current flow in a current source while maintaining a substantially constant gate bias voltage on an n-channel FET which functions as the current source. The invention is described in detail with reference to n-channel FET devices for exemplary purposes only. One skilled in the art will readily understand how to apply the method and apparatus of the present invention to p-channel FETs, metal oxide semiconductor FETs (MOSFETs), and other transconducting electronic devices.

The method and apparatus of the present invention provide for a control FET above the current source FET and below the logic that the current source serves. By bringing the gate voltage of the control FET to near the source voltage of the current source FET, the drain-to-source bias voltage on the current source FET is sufficiently collapsed to shut off the current flow. The control voltage applied to the control FET can be generated from logic devices on the same integrated circuit, thereby providing for a simple and effective method of controlling current sources without modifying a bias generator.

Figure 1:
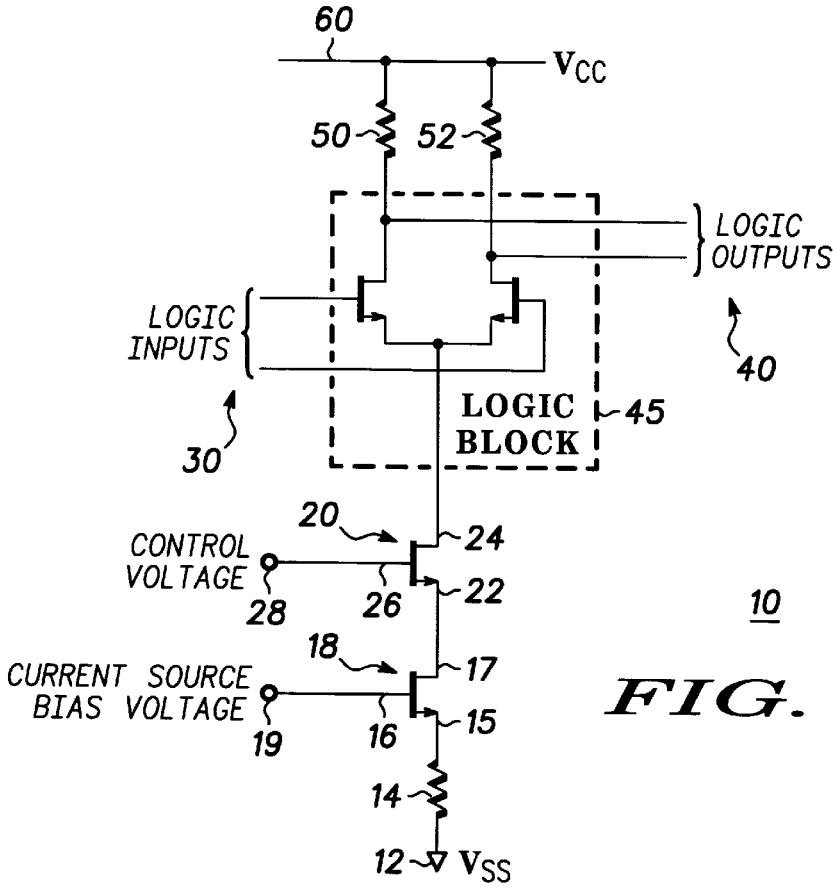
FIG. 1 shows a current steering logic device in accordance with a preferred embodiment of the present invention.

Turning now to the drawings in which like reference characters indicate corresponding elements throughout the several views, attention is first directed to FIG. 1. FIG. 1 shows a current steering logic device in accordance with a preferred embodiment of the present invention. Current steering logic device 10 includes logic block 45, load resistors 50 and 52, current source FET 18, and control FET 20. Current steering logic device 10 is implemented in source coupled FET logic (SCFL). SCFL is a logic family that implements logical functions by switching currents from one path to another. One skilled in the art will understand that the method and apparatus of the present invention is applicable to logic families other than SCFL, such as Current Mode Logic (CML).

For exemplary purposes, logic block 45 is shown in FIG. 1 as an inverter or a buffer. When one of logic inputs 30 is high, and the other is low, current is higher in one of load resistors 50 and 52, and lower in the other, and the voltage on the two logic outputs 40 is higher than the other. Logic block 45, is shown as an inverter or buffer for exemplary purposes only. One skilled in the art will understand that many alternative logic blocks can be substituted for logic block 45 while still practicing the present invention. Examples of other logic functions included Nand gates, Nor gates, multiplexors, and other more complex functions. Load resistors 50 and 52 function as loads which can also be implemented as active devices. The use of active devices as loads in integrated circuits is well known in the art.

When logic block 45 is operational, it is desirable to have a substantially constant current flowing from Vcc 60 to Vss 12 so fewer capacitances are charged and discharged when changing logical state. Portions of the substantially constant current are switched from one path to another very quickly, thereby providing for very fast switching speeds. A substantially constant current is provided by current source FET 18. Current source FET 18 includes source 15, drain 17, and gate 16. Current source bias voltage 19 is applied to gate 16 so that current source FET 18 supplies a substantially constant current as long as the drain-to-source bias voltage on current source FET 18 is high enough to cause current source FET 18 to operate in a region of saturation. For example, in conventional devices fabricated using modern technologies, bias voltage 19 can be set at approximately 0.8 volts above source 15, and as long as the drain-to-source bias voltage remains above about one volt, current source FET 18 will supply a substantially constant current. Of course, the gate to source voltage on current source FET 18 can be maintained substantially constant at a voltage other than 0.8 volts, thereby causing the amount of current provided by current source FET 18 to be different. Source 15 is coupled to Vss 12 through degeneration resistor 14. Degeneration resistor 14 is not necessary, and is included in FIG. 1 for completeness. The use and operation of degeneration resistors in current sources is well known in the art. Vss 12 functions as a reference potential for the entire circuit.

Control FET 20 is stacked on top of current source FET 18 in a totem-pole configuration. Control FET 20 includes drain 24, source 22, and gate 26. Drain 24 is coupled to logic block 45, source 22 is coupled to drain 17 of current source FET 18, and gate 26 has control voltage 28 applied thereto.

Control voltage 28 on gate 26 can be used to modulate the current provided by current source FET 18. For example, in the current source example previously given where the drain-to-source bias voltage on current source FET 18 is maintained above about one volt, as long as control voltage 28 is maintained at one gate to source voltage above drain 17, the current flow in current source FET 18 will not be modulated. As control voltage 28 is dropped below that point however, current source FET 18 will be modulated, and the current flowing from drain 17 to source 15 will drop. As control voltage 28 is dropped further, the current flow will experience a correspondingly further drop, and if control voltage 28 is dropped to Vss 12, the drain-to-source bias voltage on current source FET 18 will be collapsed to zero and the current flow will substantially stop.

For the purpose of explanation, and not by way of limitation, exemplary voltages are as follows. Vcc 60 is ground. Vss 12 is −5V. Bias voltage 19 is kept substantially constant at approximately −4.0V. Control voltage 28, when the current source is supplying substantially constant current, is kept at or above about −3.5V. Control voltage 28, when current source FET is shut off, is at Vss 12, or about −5V. One skilled in the art will understand that these voltages are exemplary, and can be modified while still practicing the present invention.

Current steering logic families operate with voltages from the positive rail (Vcc) to the negative rail (Vss) large enough to accommodate a current source, as well as the logic which exists above it. In this example the voltage difference between Vcc and Vss is 5V. Lower or higher voltages can be used, but a minimum voltage exists where the current source will cease operation and/or the logic above the current source will cease to operate. This is in contrast to saturating logic families such as complementary logic where currents stop as a result of switching state. Saturating logic families can generally be powered by lower supply voltages than can current steering logic families.

Control FET 20 provides an advantageous means for controlling the current flow through current source FET 18 without modifying current source bias voltage 19. Current source bias voltage 19 can be generated by a bias generator serving an entire integrated circuit, while the current source for any given logic block can be controlled using control voltage 28. As is explained more fully with reference to the following figures, the control voltage can be conveniently generated, thereby providing a simple and efficient mechanism for controlling current sources in individual logic blocks without modifying a bias generator.

Figure 2:
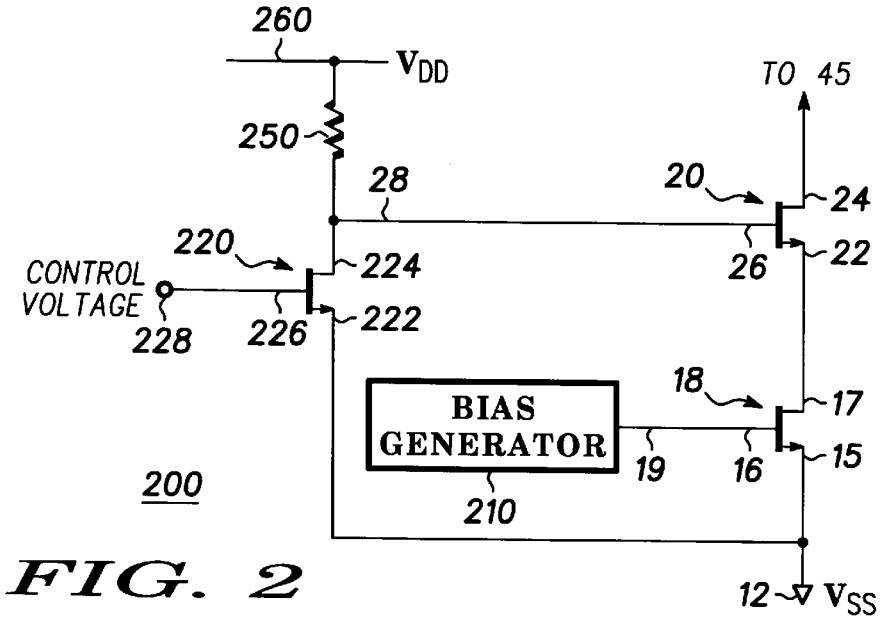
FIG. 2 shows a current source in accordance with a first embodiment of the present invention.

FIG. 2 shows a current source in accordance with a first embodiment of the present invention. Current source 200 includes current source FET 18, control FET 20, bias generator 210, transistor 220, and resistor 250. Bias generator 210 produces a substantially constant bias voltage 19 that is applied to gate 16 of current source FET 18. Bias generator 210 also preferably provides bias voltage 19 to multiple other current source FETs sharing the same die as current source FET 18. Bias generators of this type are well known in the art. Current source FET 18 provides current for logic block 45 (FIG. 1). The operation of control FET 20 is the same as that explained with reference to FIG. 1. Control voltage 28 is supplied by a driver circuit which is comprised of transistor 220 and resistor 250. When control voltage 228 applied to gate 226 of transistor 220 is low enough such that transistor 220 is off, Vdd 260 will appear as control voltage 28 on control FET 20. As previously explained, when control voltage 28 is at or above about 1.5 volts above VSS 12, current source FET 18 is not modulated. This is a very advantageous result, in part because the driver circuit can be powered by a power supply different from that used to power the current steering logic. In this example, Vdd 260 can be at about 1.5 volts which is a voltage readily available in modern designs for powering complementary logic, such as Complementary Metal Oxide Semiconductor (CMOS). An example of a complementary driver circuit is given in FIG. 3.

FIG. 3 shows a current source in accordance with a second embodiment of the present invention. Current source 300 includes current source FET 18, control FET 20, and bias generator 210. Current source 300 also includes a driver circuit comprised of complementary transistors 320 and 220, and complementary logic 310. Transistor 320 is shown in FIG. 3 as a p-channel FET and transistor 220 is shown as an n-channel FET, but one skilled in the art will understand that any type of complementary pair of transistors can be substituted while still practicing the present invention. As signal 328 is switched between Vdd 260 and Vss 12, current source 300 is turned on and off. Complementary logic 310 can be made up of any possible logic implemented in very power efficient complementary logic.

Current source 300 is very advantageous, in part because complementary logic powered from a readily available supply voltage can be utilized to control current sources individually within an integrated circuit. Portions of large integrated circuits which include many logic blocks can be advantageously powered down using the method and apparatus in the present invention. This is accomplished with complementary logic which is both efficient and simple to implement. Chip-wide bias generators can advantageously be maintained substantially constant while practicing the present invention.

FIG. 4 shows a flowchart of a method of controlling a current source in accordance with a preferred embodiment of the present invention. Method 400 begins with step 410 when a substantially constant gate bias voltage is applied to a current source FET. The substantially constant gate bias voltage of step 410 is preferably that which is provided by bias generator 210 (FIG. 3). In step 420, a control voltage is applied to a control FET which has a drain coupled to a source of the current source FET. This interconnection of the control FET and a current source FET is preferably the totem-pole configuration as shown in FIGS. 1 through 3.

In step 430 a decision is made whether to increase the current. If the current is to be increased, the method proceeds the step 440, otherwise the method proceeds with step 450. In step 440, the control voltage on the control FET is increased sufficiently to cause the drain-to-source bias voltage of the current source FET to increase such that the current source FET operates in a region of saturation. In step 450, a decision is made whether to increase the current. If the current is to be decreased, method 400 continues with step 460. If the current is not to be decreased, method 400 ends. In step 460, the control voltage on the control FET is decreased sufficiently to cause the drain-to-source bias voltage of the current source FET to decrease such that the current source FET does not operate in a region of saturation. In step 470 a decision is made whether to shut off the current source. If the current source is not to be shut off, method 400 ends, otherwise method 400 proceeds with step 480. In step 480, the drain-to-source bias voltage of the current source FET is decreased to a point that the current source FET does not conduct current from drain to source.

In summary, the method and apparatus of the present invention provides an advantageous means for controlling the current flow in current sources. While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

What is claimed is:

1. A current source comprising:

a current source FET having a source, a gate, and a drain, said current source FET having a drain-to-source bias voltage applied between the drain and the source, said gate having a substantially constant gate bias voltage applied thereto, thereby causing the current source FET to have a substantially constant current flow from drain to source when the drain-to-source bias voltage on the current source FET is sufficiently high to cause the current source FET to operate in a region of saturation;

a control FET having a source coupled to the drain of the current source FET, and a gate having a control voltage applied thereto, wherein when said control voltage, when dropped, reduces the drain-to-source bias voltage on the current source FET, thereby stopping the current source FET from operating in a region of saturation and reducing the current flow in the current source FET;

a driver circuit for generating the control voltage, the driver circuit including a switch coupled between the gate of the control FET and the source of the current source FET; and a resistor coupled between the gate of the control FET and a first supply voltage, wherein the first supply voltage is great enough so that when applied to the gate of the control FET, the current source FET operates in the region of saturation.

2. The current source of claim 3 wherein the current source FET and the control FET are n-channel FETs.

3. The current source of claim 1 wherein said switch is an n-channel FET.

4. The current source of claim 1 wherein the first supply voltage is just great enough so that when applied to the gate of the control FET, the current source FET operates in the region of saturation.

5. The current source of claim 1 wherein the current source provides current for a logic block coupled to the drain of the control FET, the logic block being powered by a second supply voltage, which is greater than said first supply voltage.

6. A current source comprising:

a current source FET having a source, a gate, and a drain, said current source FET having a drain-to-source bias voltage applied between the drain and the source, said gate having a substantially constant gate bias voltage applied thereto, thereby causing the current source FET to have a substantially constant current flow from drain to source when the drain-to-source bias voltage on the current source FET is sufficiently high to cause the current source FET to operate in a region of saturation;

a control FET having a source coupled to the drain of the current source FET, and a gate having a control voltage applied thereto, wherein when said control voltage, when dropped, reduces the drain-to-source bias voltage on the current source FET, thereby stopping the current source FET from operating in a region of saturation and reducing the current flow in the current source FET; and a driver circuit for generating the control voltage, the driver circuit including:

a first switch coupled between the gate of the control FET and the source of the current source FET; and a second switch coupled between the gate of the control FET and a first supply voltage, wherein the first supply voltage is great enough so that when applied to the gate of the control FET, the current source FET operates in the region of saturation.

7. The current source of claim 6 wherein one of said first and second switches is an n-channel FETs.

8. The current source of claim 6 wherein said first and second switches are complementary FETs.

9. The current source of claim 6 wherein the first supply voltage is just great enough so that when applied to the gate of the control FET, the current source FET operates in the region of saturation.

10. The current source of claim 6 wherein the current source provides current for a logic block coupled to the drain of the control FET, the logic block being powered by a second supply voltage, which is greater than said first supply voltage.

* * * * *